US007685846B2

(12) United States Patent
Hwang et al.

(10) Patent No.: US 7,685,846 B2
(45) Date of Patent: Mar. 30, 2010

(54) ASSEMBLY FOR STACKING WASHERS AND DRYERS

(75) Inventors: Sung Gi Hwang, Changwon-si (KR); Jeung Gie Ahn, Seoul (KR)

(73) Assignee: LG Electronics Inc., Seoul (KR)

( * ) Notice: Subject to any disclaimer, the term of this patent is extended or adjusted under 35 U.S.C. 154(b) by 995 days.

(21) Appl. No.: 11/019,123

(22) Filed: Dec. 22, 2004

(65) Prior Publication Data

US 2005/0139738 A1 Jun. 30, 2005

(30) Foreign Application Priority Data

Dec. 29, 2003 (KR) ..... 10-2003-0098951
Dec. 29, 2003 (KR) ..... 10-2003-0098952

(51) Int. Cl.
*B08B 3/12* (2006.01)

(52) U.S. Cl. ..... 68/3 R; 248/188.1; 248/682; 312/107; 211/194

(58) Field of Classification Search ..... 248/346.01, 248/510, 501, 500, 505, 680, 117.6, 117.7, 248/309.1, 121, 154, 639, 316.1, 503.1, 506, 248/502; 68/3 R; 312/198, 199, 263, 264, 312/107, 111, 265.5, 271; 211/194
See application file for complete search history.

(56) References Cited

U.S. PATENT DOCUMENTS 974,681 A * 11/1910 Manquais ..... 248/300
1,063,716 A * 6/1913 McLaughlin ..... 248/681
1,064,005 A * 6/1913 Pritzl ..... 248/681
1,450,183 A * 4/1923 Moon ..... 248/680
1,508,326 A * 9/1924 Hensley ..... 248/681
1,551,516 A * 8/1925 McGovern ..... 248/681
1,656,640 A * 1/1928 Kurowski ..... 248/680
1,758,646 A * 5/1930 Brown ..... 248/681
1,801,354 A * 4/1931 Lindburg ..... 248/681
1,823,753 A * 9/1931 Muhlfeld ..... 248/681
2,628,373 A * 2/1953 Swanson ..... 5/425
2,644,390 A * 7/1953 Delf ..... 454/209
3,212,739 A * 10/1965 Morris ..... 248/681
3,237,898 A * 3/1966 Goss ..... 248/478
4,055,320 A * 10/1977 Bengtsson ..... 248/501
4,395,586 A * 7/1983 Eiermann et al. ..... 174/138 J
4,454,732 A * 6/1984 Burkland et al. ..... 68/3 R
4,680,948 A * 7/1987 Rummel et al. ..... 68/3 R
4,821,535 A * 4/1989 Wassilak et al. ..... 68/3 R
4,890,813 A * 1/1990 Johnson et al. ..... 248/680
5,076,079 A * 12/1991 Monoson et al. ..... 70/58
5,624,098 A * 4/1997 McDowell ..... 248/550

(Continued)

FOREIGN PATENT DOCUMENTS

DE 3329615 2/1985

(Continued)

*Primary Examiner*—Kimberly T Wood
(74) *Attorney, Agent, or Firm*—McKenna Long & Aldridge LLP

(57) ABSTRACT

The present invention is to provide an assembly for stacking washer and/or dryers, by which washers/dryers, washers, or dryers can be stacked. The present invention includes at least one bracket provided to a top portion of a first washer or dryer and at least one holder provided to the bracket to hold a leg of a second washer or dryer put on the first washer or dryer.

43 Claims, 9 Drawing Sheets

U.S. PATENT DOCUMENTS 5,690,311 A * 11/1997 Leighton et al. ..... 248/681
5,785,397 A * 7/1998 Pavelski ..... 312/111
6,029,940 A * 2/2000 Klein ..... 248/346.04
6,047,940 A * 4/2000 Kaplan ..... 248/501
6,176,562 B1 * 1/2001 Hart ..... 312/351.1
6,427,966 B1 * 8/2002 Blumenschein ..... 248/678
6,533,238 B2 * 3/2003 Barnes et al. ..... 248/680
7,024,801 B2 * 4/2006 Hwang ..... 34/603
7,240,889 B2 * 7/2007 Giovinazzi ..... 248/501

FOREIGN PATENT DOCUMENTS

| | | |
|---|---|---|
| DE | 3827790 | 2/1990 |
| EP | 0 618 322 | 10/1994 |
| EP | 0 667 412 | 8/1995 |
| FR | 2672962 | 8/1992 |

* cited by examiner

ASSEMBLY FOR STACKING WASHERS AND DRYERS

This application claims the benefit of the Korean Application Nos. P2003-98951 and P2003-98952 both filed on 29 Dec., 2003, which is hereby incorporated by reference.

BACKGROUND OF THE INVENTION

1. Field of the Invention

The present invention relates to washers and dryers, and more particularly, to an assembly for stacking washer and/or dryers.

2. Discussion of the Related Art

Generally, a washer is an apparatus for washing a laundry and includes a drum rotatably provided within a housing and a driving device for rotating the drum. The washer is classified into a top loading type and a front loading type according to a posture of the drum. The front loading type washer includes a drum that is laid down, whereas the top loading type washer has an upright drum. Hence, a laundry is inputted to the washer via a front side of the washer. Compared to the top loading type washer, the front loading type washer has a small volume and a bigger washing capacity. And, the front loading type washer has high washing performance without raveling the laundry to be popular in use.

Lately, a front loading type dryer having a laid-down drum has been developed. A washed laundry is inputted to the front loading type dryer via a front side for drying, thereby having many advantages similar to those of the front loading type washer.

FIG. 1 is a perspective diagram of a washer or dryer according to a related art.

Referring to FIG. 1, a washer or dryer includes a housing that consists of a pair of side panels 50, a back panel (not shown in the drawing) provided to rear ends of the side panels 50, a front panel 10 provided to front ends of the side panels 50, a top panel 20 provided over the side, back, and front panels, and a base panel (not shown in the drawing) provided beneath the side, back, and front panels. A door 10*a* for inputting a laundry and a control panel 30 for controlling an operation are provided to the front panel 10. And, several legs 60 are provided to the base panel to support weight of the washer or dryer. In the washer, a drum and its driving device are basically installed within the housing. In the dryer, a drum, a driving device, and a heating device for generating hot air are basically installed within the housing.

The washer and dryer are mostly used together in a home or a cleaner's. Specifically, in the cleaner's, a multitude of washers and dryers are used together. And, the washers and the dryers are separately grouped or combined altogether.

However, the washers and/or dryers need to be arranged side by side, thereby occupying a big space unnecessarily.

SUMMARY OF THE INVENTION

Accordingly, the present invention is directed to an assembly for stacking washer and/or dryers that substantially obviates one or more problems due to limitations and disadvantages of the related art.

An object of the present invention is to provide an assembly for stacking washer and/or dryers, by which washers/dryers, washers, or dryers can be stacked.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, an assembly for stacking washers and/or dryers according to the present invention includes at least one bracket provided to a top portion of a first washer or dryer and at least one holder provided to the bracket to hold a leg of a second washer or dryer put on the first washer or dryer.

Preferably, the holder includes at least one flange having an angle shape cross-section. Preferably, the holder includes a pair of flanges separated from each other to leave a prescribed interval and a pair of the flanges are configured to latch the corresponding leg.

Preferably, the assembly further includes a stopper provided in rear of the holder to support a rear portion of the leg.

Preferably, the assembly further includes a supplementary bracket configured to prevent the leg from being separated forward from the holder in case of coupling the leg with the bracket. More preferably, the supplementary bracket includes a stopper provided in front of the holder to support a front portion of the leg.

Therefore, by the present invention, the washers or dryers occupy a minimum space to be stably stacked.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
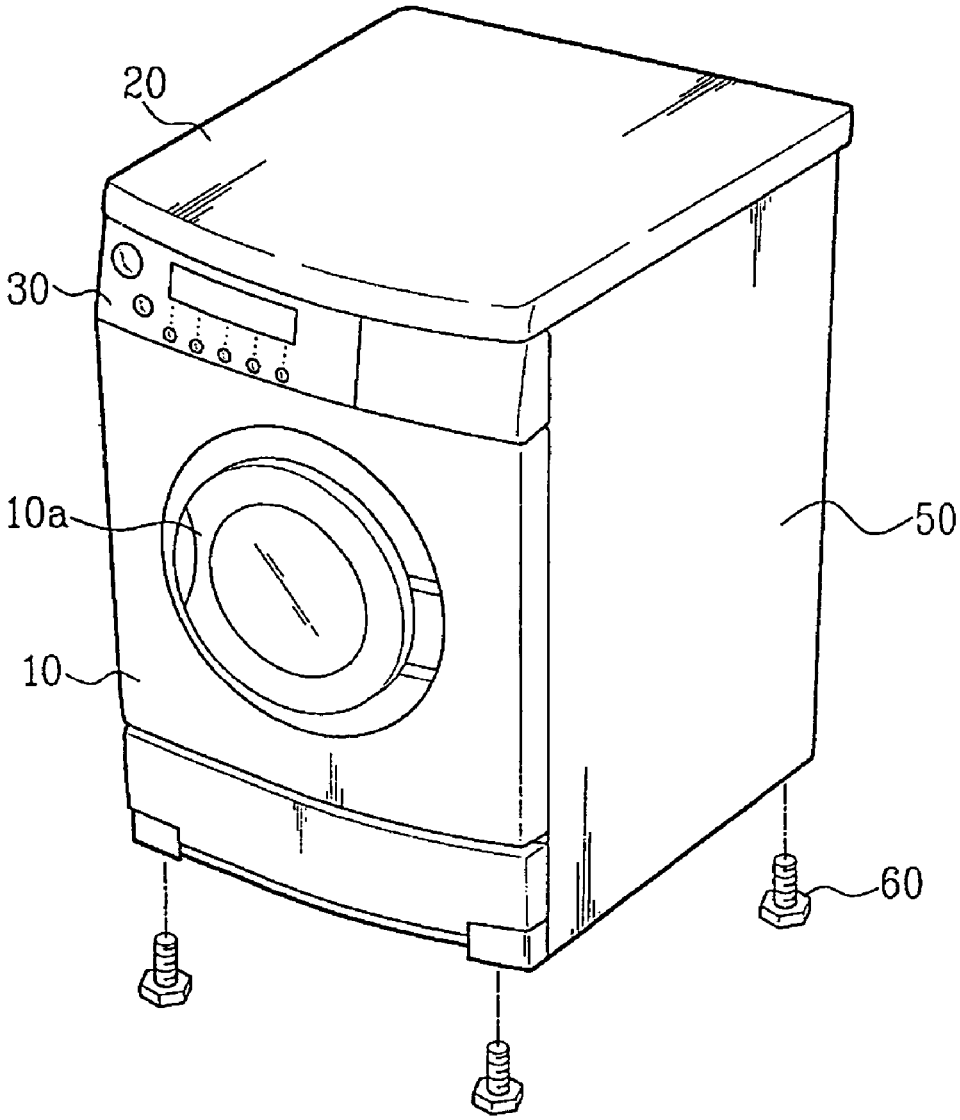
FIG. 1 Related Art
FIG. 1 is a perspective diagram of a washer or dryer according to a related art.
Figure 2:
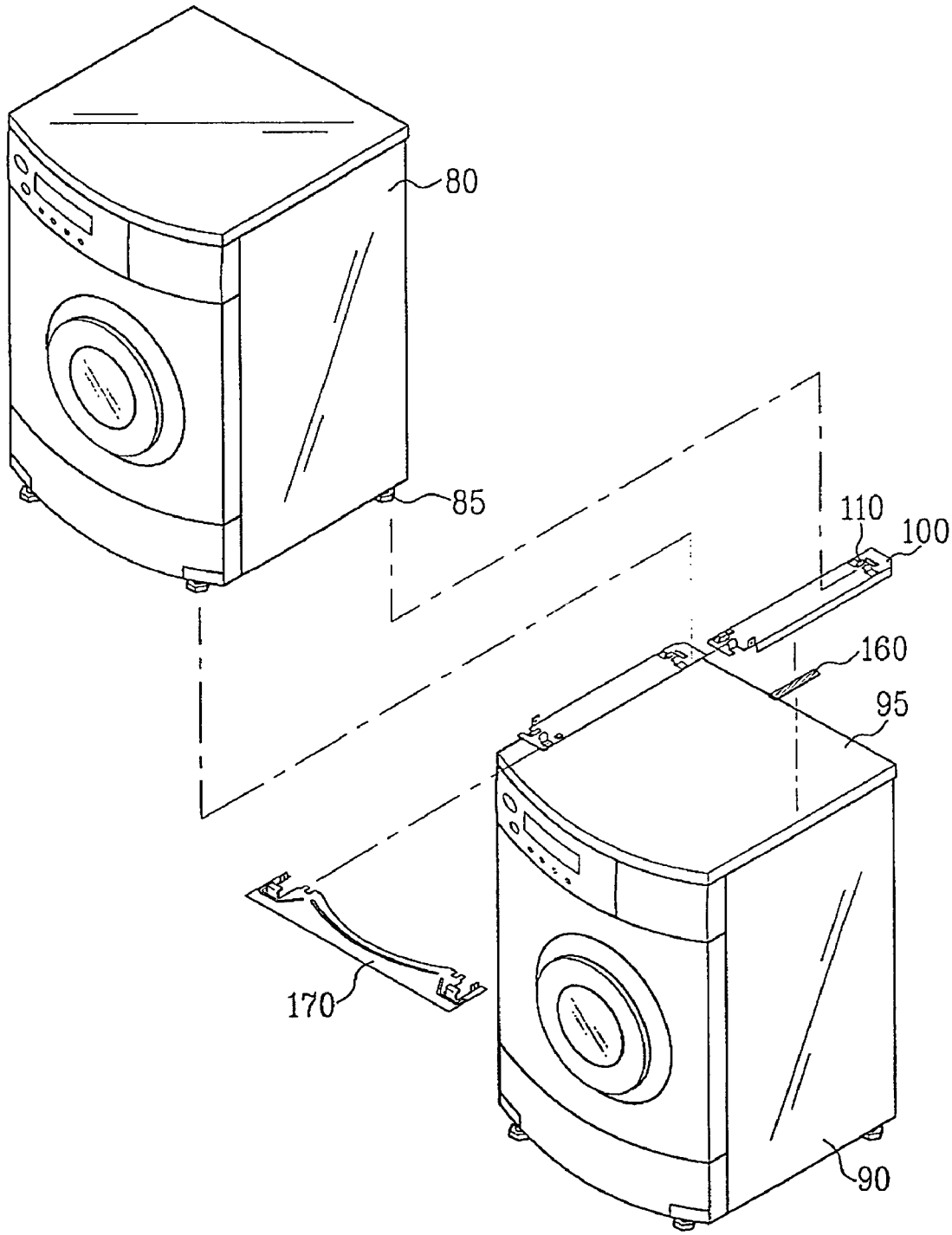
FIG. 2 is a projected perspective diagram of a washer and/or a dryer stacked on another using a stacking assembly according to the present invention.

FIG. 2 is a projected perspective diagram of a washer and/or a dryer stacked on another using a stacking assembly according to the present invention.

Referring to FIG. 2, a first device 90 is put on a floor and a second device 80 is then stacked on a top portion, i.e., a top plate 95 of the first device 90. In this case, the first device 90 can be a washer or dryer. Likewise, the second device 80 can be a washer or dryer. Hence, the first and second devices 90 and 80 may include washers only, dryers only, washing and drying machines, or a combination of washer and dryer. And, the first and second devices 90 and 80 can correspond to various combinations available for a home or a cleaner's.

A bracket 100 having a rectangular plate shape is installed on the top portion, the top plate 95 of the first device 90. The bracket 100 extends along a side part of the top plate 95. It is able to stack the second device 80 on the first device 90 using one bracket 100 only. For stable stacking, the present invention preferably provides a pair of brackets 100 on two confronting side parts of the top plate 95, respectively.

Figure 3A:
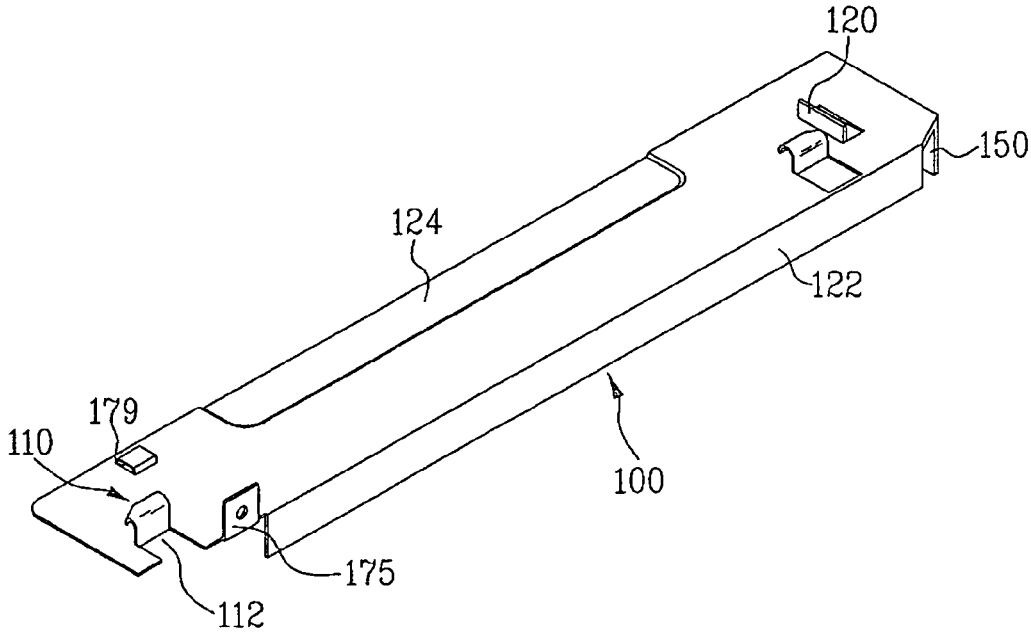
FIG. 3A and FIG. 3B are perspective diagrams of brackets of a stacking assembly according to the present invention.
Figure 3B:
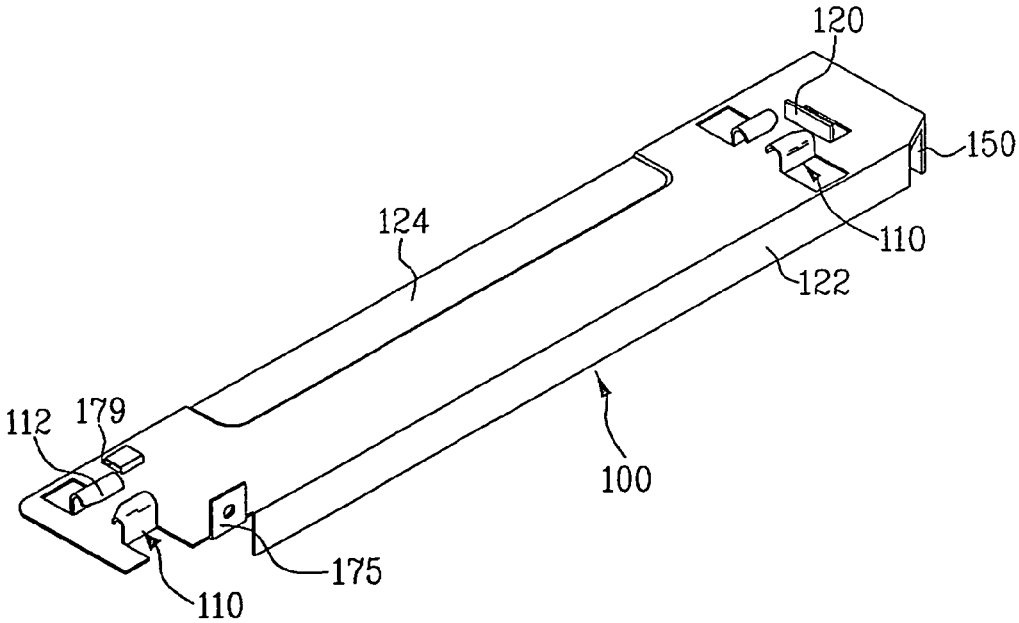
Figure 4:
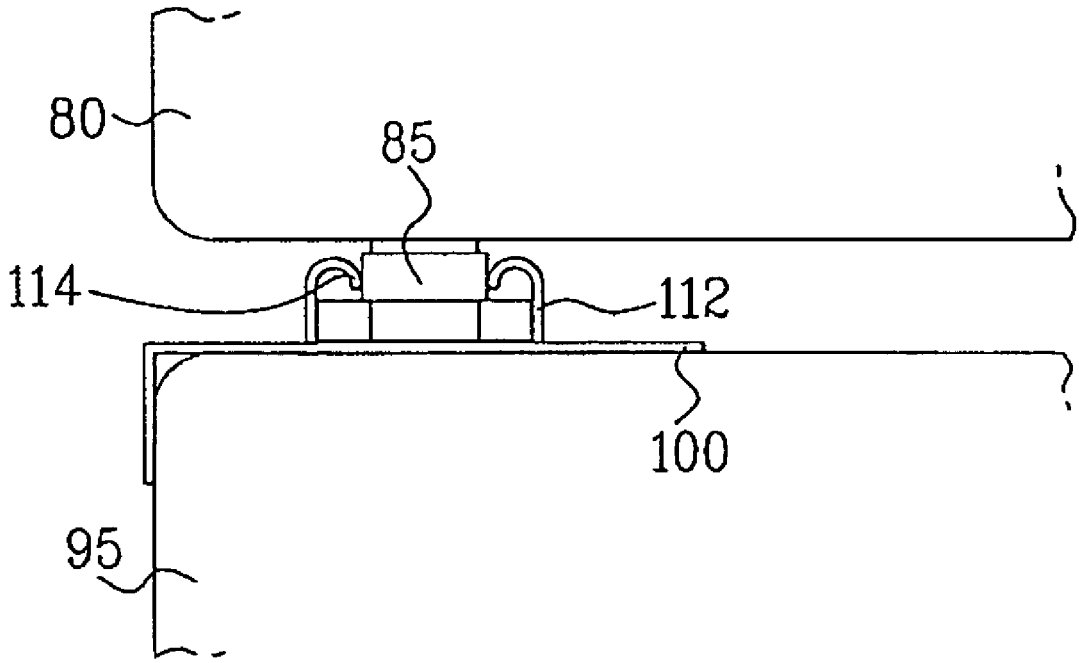
FIG. 4 is a front diagram of a leg of a washer or dryer coupled with a holder of a stacking assembly according to the present invention.

At least one holder 110, as shown in FIG. 3A and FIG. 3B, is provided to the bracket 100 to hold a leg 85 of the second device 80. The holder 110, as shown in FIG. 3A, can include one flange 112. Optionally, the holder 110, as shown in FIG. 3B, preferably includes a pair of flanges 112 to stably hold the corresponding leg 85. A tip of the flange 112 is bent to having an angle type cross-section. Hence, the leg 85 is latched by the corresponding flange 112. Namely, a top portion of the leg 85 is supported by the flange 112. Besides, a pair of the flanges 112 are formed symmetric to each other to support both lateral sides of the leg 85. Hence, the leg 85 is enclosed by the flanges 112 of the holder 110 to be stably received within the holder 110. Hence, the holder 110, as shown in FIG. 4, supports upper and lower portions and both of the lateral sides of the leg 85 together with the bracket 100, thereby holding the leg 85 tightly. Moreover, since the flanges 112 have the angle shapes, respectively, the leg 85 slides on the bracket 100 to be fitted in the holder 110. Preferably, a pair of holders 110 are provided to front and rear parts of the bracket 100, respectively. In such a case, the holders 110 hold legs, i.e., front and rear legs, arranged along one side part of the second device 80, respectively.

Figure 5:
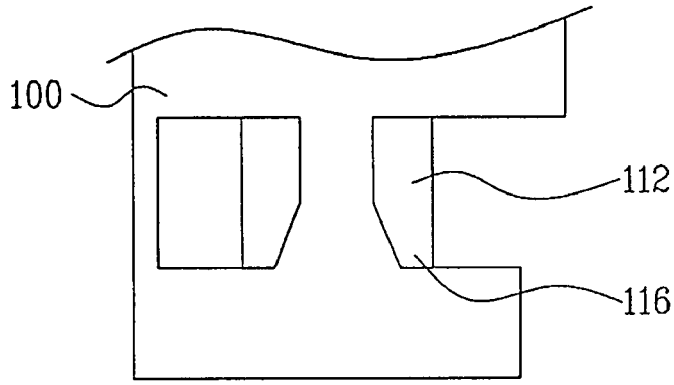
FIG. 5 is a layout of a holder of a stacking assembly according to the present invention.

Specifically, the flange 112 can be formed in a manner of shearing a portion of the bracket 100 and bending the sheared portion of the bracket 100. Meanwhile, a tip 114 of the sheared flange, as shown in FIG. 4 and FIG. 5, is sharp to cause damage to the leg 85 or to hurt a user. Hence, the tip 114 of the sheared flange is preferably curled inwardly. Moreover, each of the flanges 112, and more accurately, a front portion 116 of the tip 114 is tapered in an outer direction of the flange 112. Namely, an entrance of the holder 110 is extended so that the leg 85 can be guided inside the holder by the tapered portion in being fitted in the holder 110.

A stopper 120, as shown in FIG. 3A and FIG. 3B, is provided in rear of the holder 100 to prevent the leg 85 from being separated backward from the holder 110. The stopper 120 supports a rear side of the leg 85 to restrict a backward movement of the leg 85. The stopper 120 may be provided to the bracket 100. Substantially, the stopper 120, as shown in the drawing, is formed by bending a portion of the bracket 100. Alternatively, the stopper 120 can be built in one body of the holder 110. In doing so, a portion of the rear portion of the flange 112 is bent to form the stopper 120. In case that front and rear holders 110 are provided to the bracket 100, the stopper 120 can be provided to in each rear of the holders 110. Yet, the stopper 120, as shown in FIG. 3A and FIG. 3B, can perform its intended function by being only provided to the rear holder 110 supporting the rear leg 85 of the second device 80. Consequently, the holder 110 substantially supports the rear side of the leg 85, and more particularly, the rear side of the rear leg 85 of the second device 80, thereby preventing the leg 85 from being separated backward from the holder 110. As the stopper 120 is located in rear of the holder 110, the leg 85 becomes fitted in the holder 110 from a front side of the holder 110.

Figure 6:
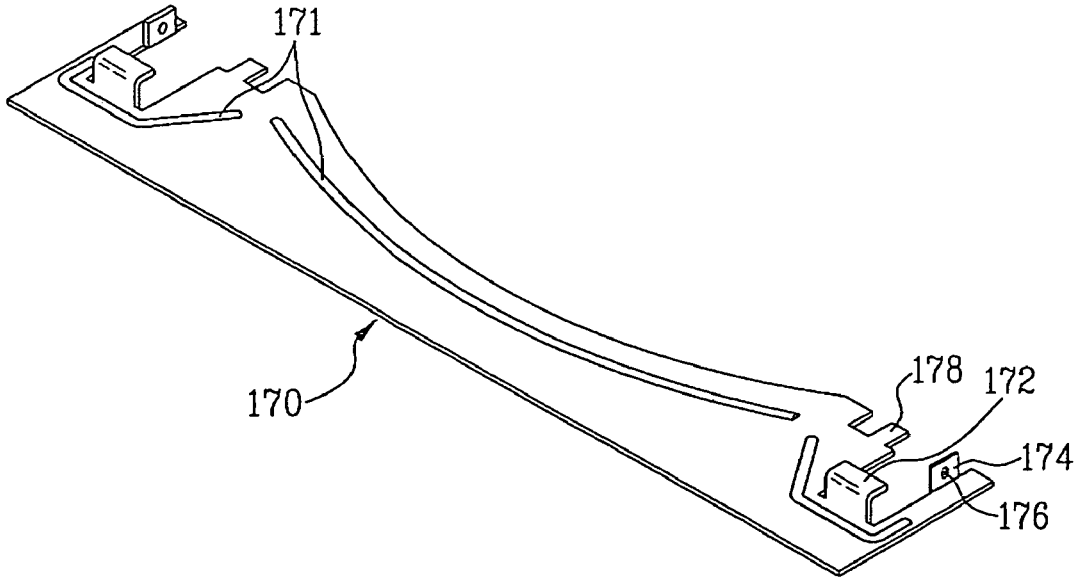
FIG. 6 is a perspective diagram of a supplementary bracket of a stacking assembly according to the present invention.
Figure 7:
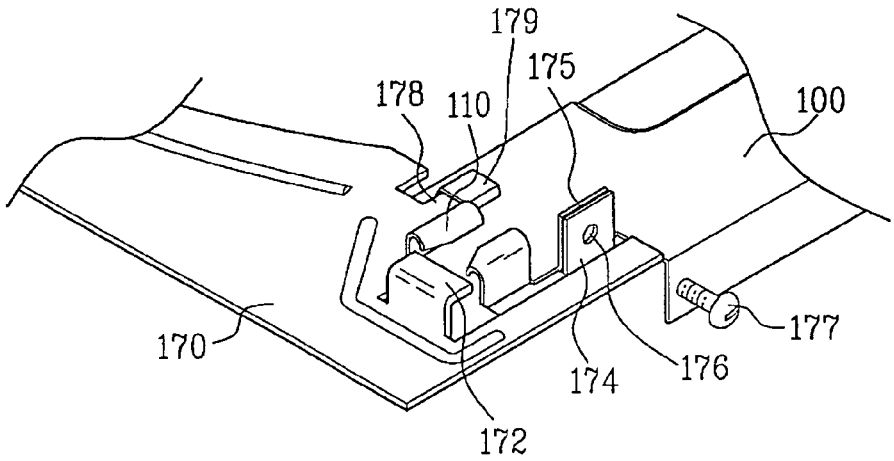
FIG. 7 is a perspective diagram of a bracket coupled with a supplementary bracket of a stacking assembly according to the present invention.

A supplementary bracket 170, as shown in FIG. 2, is coupled with the front portion of the bracket 100. The supplementary bracket 170, as shown in FIG. 6 and FIG. 7, includes a rectangular plate and at least one stopper 172. If a pair of the brackets 100 are provided to both confronting sides of the first device 90, respectively, the supplementary bracket 170, as shown in the drawing, includes a pair of stoppers 172. The stopper 172 is provided in front of the holder 120 to support a front side of the leg 85. Specifically, the stopper 172 is placed in front of the holder 110 supporting the front leg of the second device 80. Consequently, by the stopper 170, the supplementary bracket 170 substantially supports the front side of the leg 85, and more accurately, the front side of the front leg 85 of the second device 80, whereby the leg 85 is prevented from separated forward from the holder 110. As mentioned in the foregoing description, the leg 85 needs to be fitted in the holder 110 from a front side of the holder 110 due to the stopper 120. In case that the bracket 100 is installed at the first device 90 after completion of installation of the supplementary bracket 170, the leg 85 is unable to access the front side of the holder 110 due to the stopper 172. Hence, the supplementary bracket 170 needs to be installed at the first device 90 after completion of installation of the bracket 100. Specifically, the supplementary bracket 170 is installed at the first device 90 in a manner of putting the second device 80 on the first device 90 using the bracket 100.

A coupling mechanism for coupling the supplementary bracket 170 with the bracket 100 securely is provided to the supplementary bracket 170 and the bracket 100. The coupling mechanism, as shown in FIG. 7, includes a first flange 174 provided to one side of the supplementary bracket 170 and a second flange 175 provided to one side of the bracket 100. The first flange 174 is formed by bending a portion of the supplementary bracket 170, and the second flange 175 is formed by bending a portion of the bracket 100. The first and second flanges 174 and 175 are made to confront each other in assembling the supplementary bracket 170 to the bracket 100. Moreover, coupling holes 176 are formed at the first and second flanges 14 and 175, respectively. A bolt 177 is locked in the coupling holes 176 to couple the first and second flanges 174 and 175 with each other.

And, a guide mechanism for guiding the supplementary bracket 170 to an accurate coupling position is provided to the supplementary bracket 170 and the bracket 100. The guide mechanism includes a projection 178 provided to the supplementary bracket 170 and a recess 179 provided to the bracket 100. The recess 179 is configured to guide and deceive the projection 178 therein in assembling the supplementary bracket 170 to the bracket 100. By the guide mechanism, the supplementary bracket 170 is accurately coupled with the bracket 100, in which the coupling holes 176 of the first and second flanges 174 and 175 are aligned to each other. Moreover, a bead 171 is provided to the supplementary bracket 170 for rigidity reinforcement and distortion prevention. The bead 171 is provided to traverse a central part of the bracket 170 and to extend to a periphery of the stopper 172.

Figure 8:
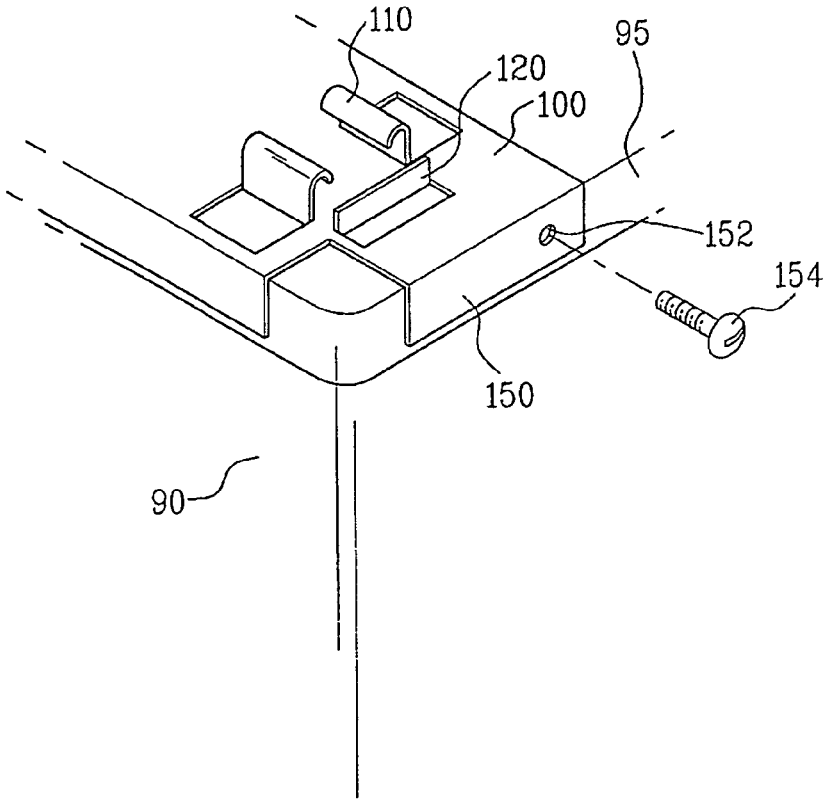
FIG. 8 and FIG. 9 are perspective diagrams for showing a rear side of a bracket in a stacking assembly according to the present invention.
Figure 9:
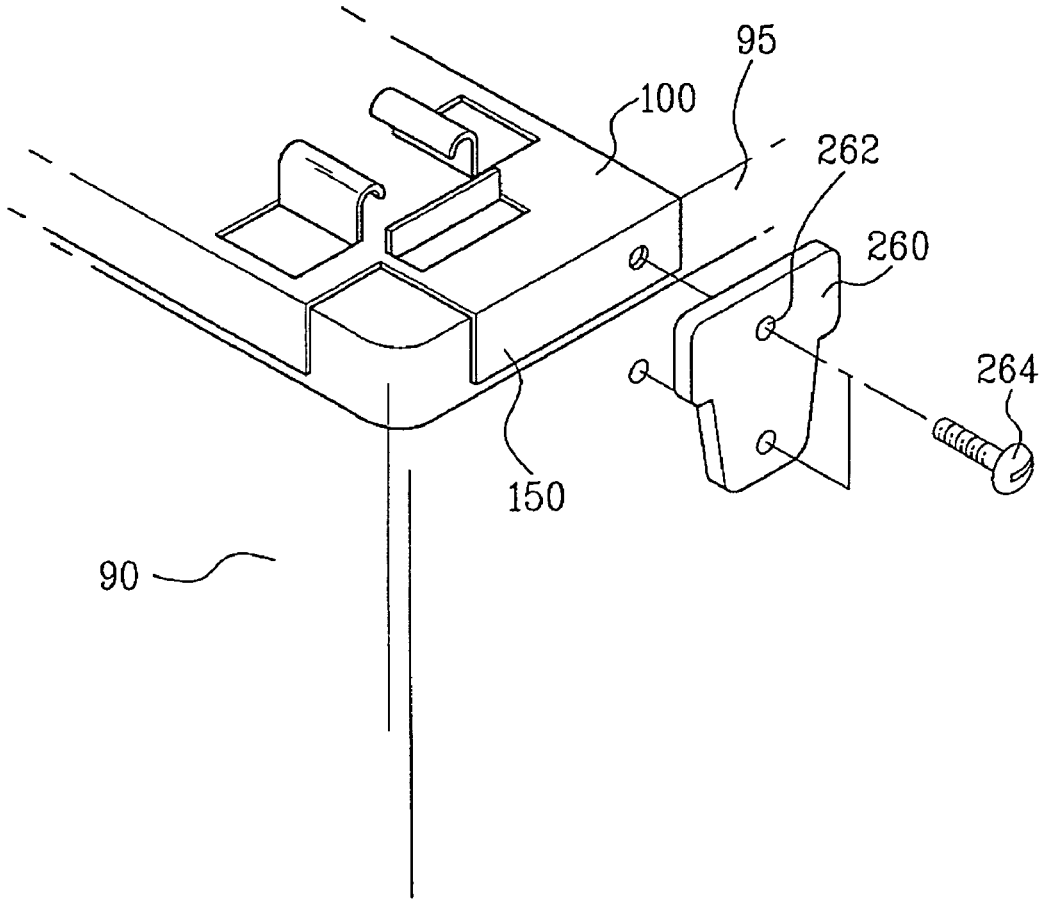

A fixing mechanism, as shown in FIG. 8 and FIG. 8, is provided to the bracket 100 to fix the bracket 100 to the first device 90. The fixing mechanism basically includes a rear flange 150 provided to a rear portion of the bracket 100 to come into contact with a backside of the first device 90. Additionally, the fixing mechanism may further include a double-sided tape 160 (cf. FIG. 2) attached to a bottom of the bracket 100 to attach the bracket 100 to the top plate 95. Screw holes 152 are provided to the rear flange 150 and the backside of the first device 90, respectively. And, a screw 154 is locked in the holes 152. Optionally, a fixing bracket 260, as shown in FIG. 9, can be further provided for fixing the bracket 100. The fixing bracket 260 is configured to cover the backside of the first device 90 and the rear flange 150 in part and includes upper and lower coupling holes 262 corresponding to the backside of the first device 90 and the rear flange 150, respectively. Hence, the an upper part of the fixing bracket 260 is fixed to the backside of the first device 90 together with the rear flange 150 and a lower part of the fixing bracket 260 is fixed to the backside of the first device 90 in direct, using the coupling holes 262 and screws 264. The bracket 100, as shown in FIG. 3A or FIG. 3B, includes a side flange 122 confronting a lateral side of the top plate 95 for smooth coupling. To reinforce rigidity, a bead 124 is provided to the bracket 100. The bead 124 is preferably provided to a side part of the bracket instead of a central part of the bracket 100 to enable the leg 85 to smoothly slide on the bracket 100 for the coupling with the holder 110.

A process of stacking the first and second devices using the stacking assembly according to the present invention is explained as follows.

First of all, the bracket 100 is assembled to the top plate 95 of the first device 90 put on the floor. The side flange 122 and the rear flange 150 of the bracket 100 are contacted with the lateral and rear sides of the top plate 95, respectively. The bracket 100 is attached to the top plate 95 using the double-sided tape 160 9 (cf. FIG. 2) attached to the bottom of the bracket 100. The rear flange 150 of the bracket 100 and the backside of the first device 90 are then fixed to each other using the locking member.

Subsequently, the second device 80 is placed over the first device 90. In doing so, by putting the rear leg 85 of the second device 80 over the bracket 100 of the first device 90 and then pushing the second device 80 backward, each of the legs 85 of the second device 80 slides on the bracket 100 to be fitted in the corresponding holder 110 from the front portion of the corresponding holder 110. Supported by the stopper 120 provided in rear of the holder 110, the corresponding leg 85 is not separated backward from the holder 110.

After completion of fitting the leg 85 in the corresponding holder 110 each, the supplementary bracket 170 is coupled with the front portion of the bracket 100. The stopper 172 of the bracket 170 supports the leg 85 within the front holder 110 of the bracket 100, thereby preventing the leg 85 from being separated forward.

Hence, the legs 85 of the second device 80 can be supported by the holders 110, respectively in vertical and horizontal directions. Moreover, the rear and front legs 85 are supported by the stoppers 120 and 172, respectively. Consequently, by the stacking assembly according to the present invention, the second device 90 is stacked on the first device 80 to be securely assembled to the first device 80.

Figure 10A:
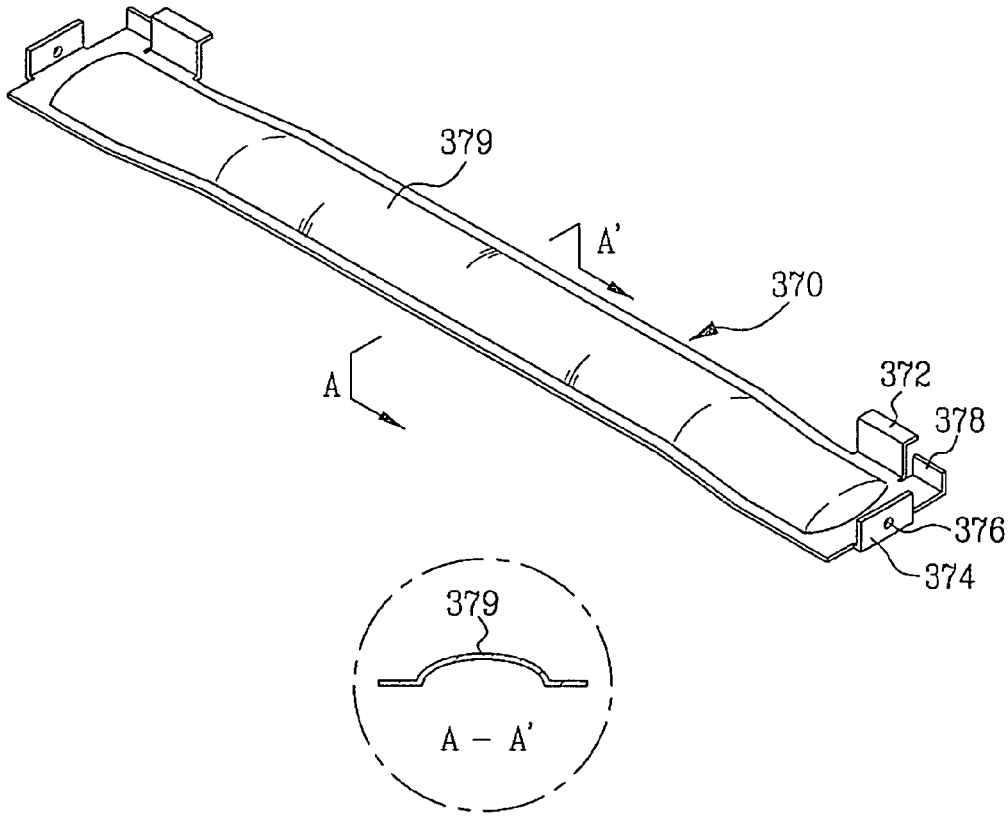
FIG. 10A and FIG. 10B are perspective diagrams of a modification of a supplementary bracket of a stacking assembly according to the present invention.
Figure 10B:
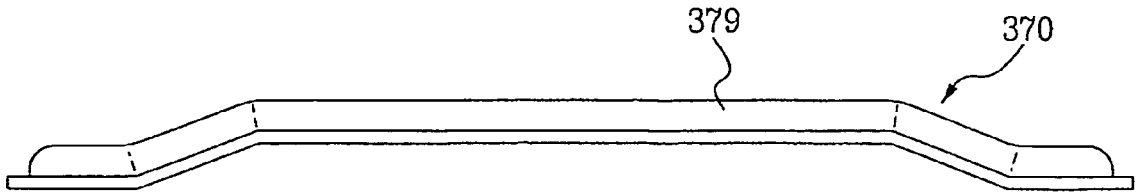
Figure 11:
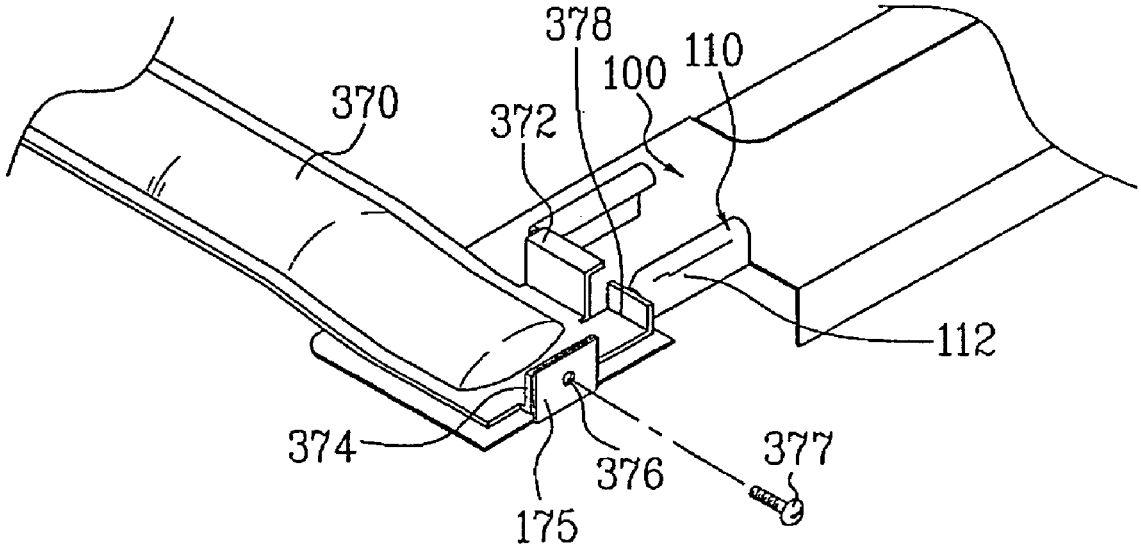
FIG. 11 is a perspective diagram of a bracket coupled with a modified supplementary bracket of a stacking assembly according to the present invention.

FIG. 10A and FIG. 10B are perspective diagrams of a modification of a supplementary bracket of a stacking assembly according to the present invention, and FIG. 11 is a perspective diagram of a bracket coupled with a modified supplementary bracket of a stacking assembly according to the present invention.

Referring to FIGS. 10A to 11, a stopper 372 and a first flange 374 are provided to a supplementary bracket 370 that is a rectangular plate. The stopper 372 and the first flange 374 are identical to the foregoing explained stopper and first flange 172 and 174, respectively, whereby their explanation will be skipped. The modified features different from those of the former embodiment of the present invention are explained as follows.

First of all, instead of the projection 178 and the recess 179, a supplementary stopper 378 is provided as a guide mechanism to the supplementary bracket 370. The supplementary stopper 378 comes into contact with a front portion of a holder 310 when the supplementary bracket 370 is coupled with a bracket 300. Hence, the supplementary bracket 378 enables the supplementary bracket 370 to be placed on an accurate coupling posture. Specifically, coupling holes 376 provided to the first and second flanges 374 and 175 for feasible coupling of the screw 377 can be aligned with each other by the supplementary stopper 378.

Moreover, to prevent distortion of the supplementary bracket 370 and to reinforce rigidity of the supplementary bracket 370, a bead 379 is formed in a length direction of the supplementary bracket 370. The supplementary bracket 370, as shown in FIG. 10A along a cutting line A-A', has a curved cross-section attributed to the bead 379 in the length direction. Moreover, the supplementary bracket 370 comes into contact with the first device 90 intermittently by the vibration of the first device 90, whereby noise may be generated. The supplementary bracket 370, as well shown in a front diagram of FIG. 10B, is bent upward to be separated from the first device 90. Hence, a contact area between the supplementary bracket 370 and the first device 90 is considerably reduces to substantially prevent the generation of noise.

Accordingly, by the assembly of the present invention, washers and/or dryers can be stacked to minimize their installation space.

Moreover, the assembly according to the present invention can lock the stacked washers and/or dryers to each other more securely.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. The combination of an assembly for stacking washers and/or dryers and washers and/or dryers, comprising:

at least one bracket at a top portion of a first washer or dryer;

at least one holder disposed on the bracket, for holding a leg of a second washer or dryer on the first washer or dryer; a rear flange provided to a rear portion of the at least one bracket to fix the at least one bracket to the washer or dryer; and screw holes provided to the rear flange and the backside of the first washer or dryer respectively; and a supplementary bracket configured to prevent separation of the leg in a forward direction from the holder when the leg couples with the bracket, wherein the bracket and the supplementary bracket comprises a first flange and a second flange, respectively, wherein the first and second flanges are configured to face each other when the bracket and the supplementary bracket are assembled to each other, and wherein the first and second flanges are coupled with each other by a locking member.

2. The combination of an assembly and washers and/or dryers of claim 1, wherein the at least one bracket extends along a side portion of the top portion of the first washer or dryer.

3. The combination of an assembly and washers and/or dryers of claim 1, wherein the at least one bracket comprises a pair of the brackets that are disposed on side portions of the top portion of the first washer or dryer.

4. The combination of an assembly and washers and/or dryers of claim 1, wherein the holder is configured to support side portions of the leg.

5. The combination of an assembly and washers and/or dryers of claim 1, wherein the holder is configured to support an upper portion of the leg.

6. The combination of an assembly and washers and/or dryers of claim 1, wherein the holder is configured to hold the leg therein.

7. The combination of an assembly and washers and/or dryers of claim 1, wherein the holder is configured to enclose the leg therein.

8. The combination of an assembly and washers and/or dryers of claim 1, wherein the at least one holder comprises a pair of the holders that support the leg and a second leg disposed on one side of the first washer or dryer.

9. The combination of an assembly and washers and/or dryers of claim 1, wherein the holder comprises at least one flange configured to latch the leg.

10. The combination of an assembly and washers and/or dryers of claim 1, wherein the holder comprises at least one flange having an angular shaped cross-section.

11. The assembly of claim 10, wherein the each of the at least one flange is a pair of flanges separated from each other to leave a prescribed interval and wherein the pair of the flanges are configured to latch the corresponding leg.

12. The assembly of claim 1, wherein the holder comprises a pair of flanges having an angular shaped cross-section each to latch the corresponding leg.

13. The assembly of claim 12, wherein the pair of the flanges are horizontally symmetric to each other.

14. The combination of an assembly and washers and/or dryers of claim 10, wherein the at least one flange is formed by bending a portion of the bracket.

15. The combination of an assembly and washers and/or dryers of claim 10, wherein a tip of the at least one flange is inwardly curled.

16. The combination of an assembly and washers and/or dryers of claim 1, wherein the holder is configured to guide the leg such that the leg is held within the holder.

17. The combination of an assembly and washers and/or dryers of claim 10, wherein a front portion of the at least one flange is outwardly tapered.

18. The combination of an assembly and washers and/or dryers of claim 1, wherein the holder is configured to prevent separation of the leg from the holder.

19. The combination of an assembly and washers and/or dryers of claim 1, wherein the holder is configured to support a rear portion of the leg.

20. The combination of an assembly and washers and/or dryers of claim 1, wherein the holder is configured to support a rear portion of a rear leg of the second washer or dryer.

21. The combination of an assembly and washers and/or dryers of claim 1, further comprising a stopper disposed at a rear of the holder to support a rear portion of the leg.

22. The combination of an assembly and washers and/or dryers of claim 21, wherein the stopper is disposed on the bracket.

23. The combination of an assembly and washers and/or dryers of claim 21, wherein the stopper is built into the holder.

24. The combination of an assembly and washers and/or dryers of claim 21, wherein the stopper is provided in a rear portion of the holder for holding a rear leg of the second washer or dryer.

25. The combination of an assembly and washers and/or dryers of claim 1, wherein the holder is configured to allow the leg to slide into the holder.

26. The combination of an assembly and washers and/or dryers of claim 1, wherein the leg fits into a front portion of the holder.

27. The combination of an assembly and washers and/or dryers of claim 1, wherein the supplementary bracket is configured to support a front portion of a front leg of the second washer or dryer.

28. The combination of an assembly and washers and/or dryers of claim 1, wherein the supplementary bracket extends over a front portion of the top portion of the first washer or dryer.

29. The combination of an assembly and washers and/or dryers of claim 1, wherein the supplementary bracket comprises a stopper disposed at a front portion of the holder where the stopper supports a front portion of the leg.

30. The combination of an assembly and washers and/or dryers of claim 29, wherein the stopper is disposed at a front portion of the holder where the stopper supports a front leg of the second washer or dryer.

31. The combination of an assembly and washers and/or dryers of claim 1, wherein the supplementary bracket is installed at the first washer or dryer after installation of the bracket.

32. The combination of an assembly and washers and/or dryers of claim 1, wherein the supplementary bracket is installed on the first washer or dryer after the second washer or dryer has been placed on the first washer or dryer.

33. The assembly of claim 1, further comprising a guide mechanism configured to guide the supplementary bracket when the supplementary bracket is assembled to the bracket.

34. The assembly of claim 33, wherein the guide mechanism comprises a projection on the supplementary bracket and a recess on the bracket for receiving the projection therein.

35. The assembly of claim 33, wherein the guide mechanism comprises a supplementary stopper on the supplementary bracket wherein the supplementary stopper contacts the holder thereby aligning the supplementary bracket.

36. The combination of an assembly and washers and/or dryers of claim 1, wherein a bead is provided to the supplementary bracket for reinforcing a rigidity of the supplementary bracket.

37. The combination of an assembly and washers and/or dryers of claim 1, wherein the supplementary bracket is curved in a width direction.

38. The assembly of claim 1, wherein the supplementary bracket is bent in an upward direction such that a portion of the supplementary bracket is separated from the top portion of the first washer or dryer.

39. The assembly of claim 1, further comprising a fixing bracket extending over the rear flange and the rear side of the first washer or dryer, wherein the fixing bracket fixes the rear flange to the rear side.

40. The combination of an assembly and washers and/or dryers of claim 1, wherein the bracket is attached to the first washer or dryer using a double-sided tape.

41. The combination of an assembly and washers and/or dryers of claim 1, wherein the bracket comprises a side flange which contacts a lateral side of the first washer or dryer.

42. The combination of an assembly and washers and/or dryers of claim 1, wherein the bracket comprises a bead, wherein the bead reinforces a rigidity of the bracket.

43. The combination of an assembly and washers and/or dryers of claim 1, wherein each of the washers and dryers is configured to allow laundry to be introduced therein through a front portion thereof.

* * * * *